United States Patent [19]

Inamura et al.

[11] 3,989,084

[45] Nov. 2, 1976

[54] ROLLING SHUTTER

[75] Inventors: Kosuke Inamura; Ikira Takasaka, both of Tokyo, Japan

[73] Assignee: Bunka Shutter Kabushiki Kaisha, Tokyo, Japan

[22] Filed: Mar. 31, 1975

[21] Appl. No.: 563,474

[30] Foreign Application Priority Data

Mar. 29, 1974 Japan ..... 49-3512549

[52] U.S. Cl. ..... 160/36; 160/133

[51] Int. Cl.[2] ..... E06B 9/16

[58] Field of Search ..... 160/36, 37, 133, 220, 160/116

[56] References Cited

UNITED STATES PATENTS

| | | | |
|---|---|---|---|
| 2,207,147 | 7/1940 | Gilbertson | 49/92 |
| 2,314,003 | 3/1943 | Mader | 49/92 |
| 2,898,988 | 8/1959 | Zoll | 160/133 |
| 2,912,048 | 11/1959 | Grau | 160/133 |
| 3,302,692 | 2/1967 | Grau | 160/133 |
| 3,642,050 | 2/1972 | Piana | 160/133 |
| 3,734,161 | 5/1973 | Pierce | 160/133 |

FOREIGN PATENTS OR APPLICATIONS

| | | | |
|---|---|---|---|
| 525,986 | 2/1954 | Belgium | 160/133 |
| 1,277,395 | 10/1961 | France | 160/133 |
| 488,799 | 1/1954 | Italy | 160/133 |
| 549,696 | 10/1956 | Italy | 160/133 |
| 1,199,609 | 7/1970 | United Kingdom | 160/133 |

*Primary Examiner*—Roy D. Frazier
*Assistant Examiner*—Thomas J. Holko
*Attorney, Agent, or Firm*—Oblon, Fisher, Spivak, McClelland & Maier

[57] ABSTRACT

A rolling shutter includes a plurality of elongated slats arranged vertically in a parallel and partially overlapping relationship, each of the slats having pivot pins at both lower side ends thereof which project outwardly so as to be slidably disposed within upstanding guide rails, either in unison with, or with respect to, each other. Individual actuating members extend between each of the pivot pins of the slats and predetermined points of successively disposed slats positioned relative to the pivot pins of the successive slats so as to define moment actuating arms with respect to the pivot pins axes of the successive slats. The actuating members are laterally movable, relative to the pivot axes of the slats, at the predetermined points, and in this manner, the slats may be sequentially pivotally opened or closed when the slats are moved along the guide rails relative to each other by the actuating members.

4 Claims, 5 Drawing Figures

ROLLING SHUTTER

The present invention relates generally to a steel door and more particularly to a rolling shutter for closing an entrance to a building or protecting a window or show window against burglary.

Rolling shutters are widely used as a means for closing entrances or windows of a building, and several types of rolling shutters are already known. One of these shutters comprises a plurality of elongated slats which are made of steel plates linked like a louver. This shutter is useful for completely closing the entrance of building for fire or crime prevention, but it shuts off the light and fresh air entering into the inside of the building from outdoors.

Another previously known shutter comprises a plurality of metal pipes instead of the slats, which are spaced in a parallel relationship and connected vertically by link shaped hinges. This type of shutter is generally called a pipe shutter and adapted to be advantageously used in shops or office buildings where it is advisable to be able to look into the inside of the building through the shutter after the office hour is over. However, the shutter of this type is not effective to protect the building against a fire, smoke, storm and the like.

Also, in the prior art device, there are blinds comprising a plurality of slats made of plastic, which are generally known as Venetian blinds. In the blinds of this type, the closing and opening operation of the blinds and the regulation of the opening angle of the slats are made by means of separate mechanisms. However, the manipulation of the blinds is somewhat troublesome and the mechanisms for closing and opening the blinds and regulating the opening angle of the slats are liable to be out of order. Furthermore, the blinds of this type are held at the upper portion of windows in a laminated state when they are pulled up, the appearance of which is less appealing.

Accordingly, one object of the present invention is to provide a rolling shutter which is simple in structure and easy to operate, and eliminates operational troubles when it is used.

Another object of the present invention is to provide a rolling shutter which can be fixed to the outside of windows to be used for blinds as well as a shutter.

Still another object of the present invention is to provide a rolling shutter which is able to adjust the closing state of entrances or windows by the shutter either in conditions of completely closed or opened like Venetian blinds by a simple height adjusting operation of the shutter without the use of special auxiliary tools.

Yet another object of the present invention is to provide a rolling shutter which is able to eliminate slapping noise arising from a contact of each of the slats of the shutter when they are shifted from the open position in the mode of a lattice window to the completely closed position.

Briefly, the foregoing and other objects are attained in accordance with the present invention by the provision of a rolling shutter having a steel door, guide rails provided at both sides of the entrance to a building to draw up and down the steel door, and a shutter case accommodating the steel door to be rolled therein. The steel door comprises a plurality of elongated slats which are arranged vertically in a parallel and partially overlapping relationship between the guide rails. Each of the slats includes pivot pins at both lower side ends thereof which are projected outwardly to be disposed in the guide rails, and are slidable along the guide rails. Each of two vertically adjacent slats is connected by links which are extended downwardly from the pivot pins of the upper slat and riveted to the adjacent lower slat at the points slightly above the pivot pins of the lower slat so that the slats may be pivotally opened outwardly when the links are pushed downwardly. Also, each of the slats includes damper strips along the upper longitudinal inner surface thereof to prevent slapping noise when the lower slat is shifted to contact the adjoining upper slat for the complete closure of the shutter.

Various other objects, features and attendant advantages of the present invention will be more fully appreciated as the same become better understood by reference to the following description when considered in connection with the accompanying drawings, wherein.

Figure 1:
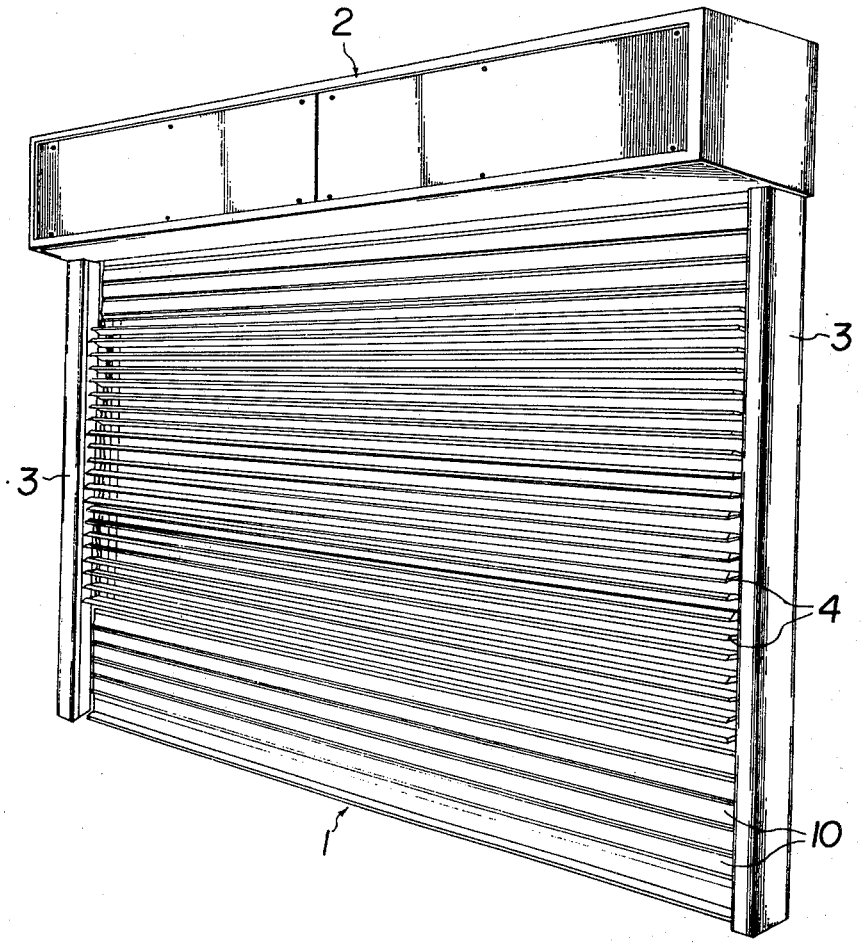
FIG. 1 is a perspective view of a rolling shutter showing a closed condition of the shutter to have slats opened in a mode of lattice window.
Figure 2:
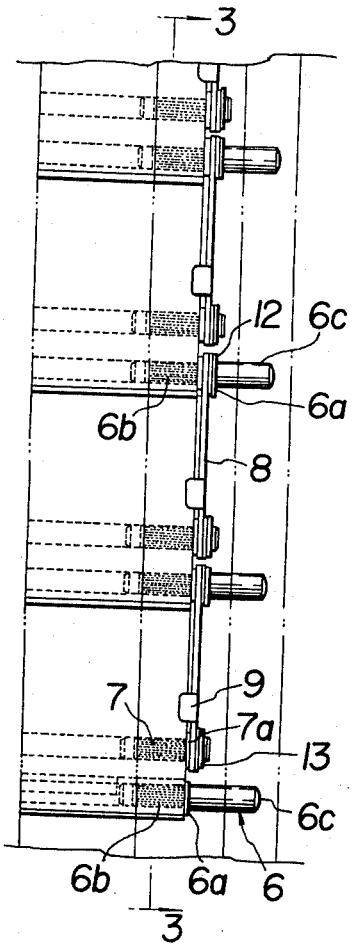
FIG. 2 is an enlarged partial plan view of the slats showing the condition of connecting the each of the slats by pins and links and the completely closed condition of the slats.
Figure 3:
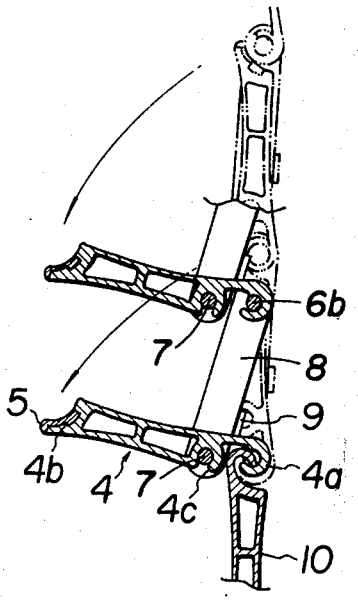
FIG. 3 is a partial sectional view of the slats taken along the line 3—3 of FIG. 2 showing the condition of opening the slats outwardly.

Referring now to the drawings, wherein like reference numerals designate identical or corresponding parts throughout the several views and more particularly to FIGS. 1 to 3 thereof, a rolling shutter of the present invention is shown as including a door 1 for closing entrances to a building, show windows, windows and the like, a shutter case 2, and guide rails 3. The door 1 comprises a plurality of elongated slats which are made of a steel or relatively mild metals such as aluminium by an extrusion molding or press forming process. According to an embodiment of the present invention, the slats 4 can be opened outwardly in the middle section of the door 1, while slats 10 connected to the upper and lower longitudinal sides of the slats 4 are stationary and always close the upper and lower sections of the entrances when the shutter is closed.

As shown in FIG. 3, the slat 4 includes a hook shaped lower portion **4*a*, relatively flat and curved inner upper surface 4*b*, and opening 4*c* above the lower portion 4*a* which is generally in the shape of a letter c in the cross section. On the upper inner surface 4*b* of the slats 4, a rubber or plastic strip 5 is affixed so as to protrude along the rear surface of the strip and is embedded in a groove of the upper surface 4*b*** of the slat by a dovetail joint.

The slats are supported between the guide rails by pins 6 which include flange **6*a* dividing the pins 6 into two sections at the middle portion thereof. One section 6*b* of the pin 6 is provided with a plurality of indents around the peripheral surface thereof, which is forcibly inserted to the inside of the hook shaped lower portion 4*a* of the slat 4, and another section 6*c* of the pin 6** extends outwardly and is disposed within the guide rail 3.

Within the opening 4*c* of the slat 4, pin 7 is inserted, which includes flange 7*a* at the head thereof and a plurality of indents around the peripheral surface thereof. Each of two vertically adjacent slats 4 are connected by link 8 which extends downwardly from the pin 6 of the upper slat 4 and secured to the pin 7 of the adjacent lower slat 4.

In this linking condition, each of the slats 4 is held under a moment of rolling outwardly due to its own weight. Numerals 12 and 13 respectively designate stopper rings for the links 8, and stopper 9 is projected from the link 8 in the side direction, which supports the front surface of the slat 4 when the slat 4 is rotated outwardly to the substantially horizontal level.

Figure 4:
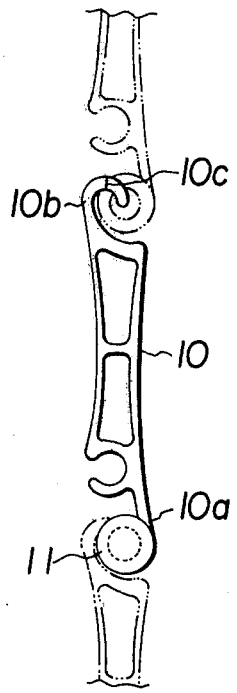
FIG. 4 is an enlarged partial side view of the slats which may be arranged within upper and lower sections of a shutter door to be connected to the slats shown in FIG. 2.
Figure 5:
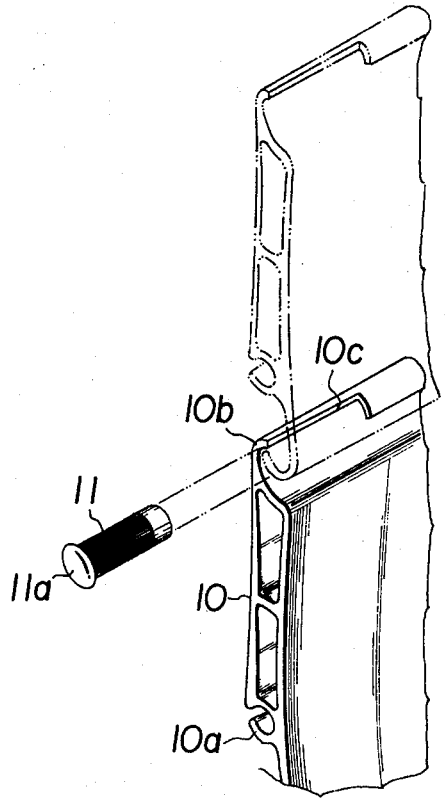
FIG. 5 is an enlarged partial perspective view of the slats showing the condition of connecting each of the slats shown in FIG. 4.

As shown in FIGS. 4 and 5, the slat 10 forming the upper and lower section of the door 1 include hook shaped portions 10*b* and 10*a* at upper and lower sides thereof, and the lower portion 10*a* is curved rearwardly, while the upper portion 10*b* is curved toward the front surface of the slat 10. Each of the slats 10 is connected vertically one after another by the engagement of the upper and lower hook shaped portions 10*b* and 10*a* of the slats 10 so that the slats may not be disengaged.

In this manner, the slats 10 are connected to be able to roll, and pin 11 having a flange 11*a* at its head and a plurality of indents along the peripheral surface thereof is driven into both side openings of the lower hook shaped portion 10*a* of the slat 10. Both sides of the upper hook shaped portion 10*b* corresponding to the length of the pins 11 are cut away as indicated by the numeral 10*c*, and pin 11 is of the circular shape to fit the inner contour of the lower hook shaped portion 10*a*.

The opening and closing operation of the shutter is made by causing a rolling shaft to rotate within the shutter case 2. When the rolling shaft is rotated in the direction of releasing the shutter, which is under the completely closed condition of the shutter contacting the upper inner surfaces 4*b* of each of the slats to the lower longitudinal outer edges of the adjacent upper slats 4 and 10, each of the slats 4 is outwardly rotated until it is come into contact with the stopper 9 due to inclined component of a force by gravity, because the upper surfaces of each of the slat 4 are held free with respect to the adjacent upper slats and the links can be moved in a radial direction. Then, the slats are moved to a substantially horizontal level in the rearward direction as shown in FIG. 3. In this condition, window openings are formed between the each of the slats and the slats 4 are open in the lattice shape.

When the rolling shaft is rotated in the winding up direction of the shutter which is under the open condition of the shutter as explained hereinabove, the links 8 are pulled upwardly and the slats 4 are rotated inwardly one after another from the upper slat at the pivot pins 6 of the lower ends thereof. Then, the upper inner surfaces 4*b* of the each of the slat 4 are in contact with the lower longitudinal outer edges of the adjacent upper slats 4 and 10, and the shutter is again in the completely closed condition. When contacting the slats, slapping noise does not arise and the surfaces of the slats 4 and 10 are not damaged due to the existence of the damper strip 5.

When the slats 4 are rolled up further from the completely closed condition of the shutter, guide portion 6*c* of the pin 6 is slid along the guide rail 3 and the slats are moved upwardly so that the entrance may be opened.

In assembling the slats 10, the upper hook shaped portion 10*b* of the slat 10 may be inserted in the lower hook shaped portion 10*a* of the slat adjacent upwardly from the side direction, and then the pins 11 are driven into the both side openings of the lower hook shaped portion 10*a* of the slat 10.

In the above arrangement, the pins 11 may be extended outwardly so as to be able to disposed within the guide rails. Also, the damper strip may be affixed to the upper inner surface 4*b* and/or the lower longitudinal outer edges of the slat.

Obviously, numerous modifications and variations of the present invention are possible in light of the above teachings. It is to be understood therefore that within the scope of the appended claims, the invention may be practiced otherwise than as specifically described herein.

What is claimed is:

1. A rolling shutter comprising:

a shutter case;

at least two upstanding guide rails;

a door slidable along said guide rails, said door including a plurality of elongated slats arranged vertically in a parallel and partially overlapping relationship, each of said slats having pivot pins at both lower side ends thereof projecting outwardly so as to be slidably disposed within said guide rails in unison with, and also with respect to, each other; and individual actuating means extending between each one of said pivot pins of each one of said slats and predetermined points on successively disposed slats positioned relative to the pivot pins of said successive slats so as to define moment actuating arms with respect to the pivot pin axes of said successive seats, said actuating means being laterally movable, relative to the pivot axes of said slats, said predetermined points, whereby each of said slats may be sequentially pivotally moved when said slats are moved along said guide rails relative to each other by said actuating means.

2. A rolling shutter according to claim 1, wherein each of said slats includes a curved inner surface at the upper longitudinal side thereof to which a damper strip is affixed.

3. A rolling shutter according to claim 1, wherein each of said slats includes hook shaped lower longitudinal edges having openings at both side ends thereof in which said pivot pins are disposed.

4. A rolling shutter as set forth in claim 1, wherein: said actuating means comprise links.

* * * * *